US006319025B1

(12) United States Patent
Sudo

(10) Patent No.: US 6,319,025 B1
(45) **Date of Patent: *Nov. 20, 2001**

(54) SURFACE INSTALLING TYPE CONNECTOR

(75) Inventor: Hirofumi Sudo, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,959

(22) Filed: Jul. 17, 1998

(30) Foreign Application Priority Data

Jul. 17, 1997 (JP) ..... 9-192343

(51) Int. Cl.[7] ..... H01R 12/00
(52) U.S. Cl. ..... 439/83; 439/876
(58) Field of Search ..... 439/83, 876, 55, 439/70, 76.1, 78, 80, 81, 84, 874, 74

(56) References Cited

U.S. PATENT DOCUMENTS 4,679,889 * 7/1987 Seidler ..... 439/876
4,682,829 * 7/1987 Kunkle et al. ..... 439/83
5,188,535 * 2/1993 Bertho et al. ..... 439/83
5,383,797 * 1/1995 Seong et al. ..... 439/476
5,612,855 * 3/1997 Heeb et al. ..... 361/773
5,639,248 * 6/1997 Yagi ..... 439/74
5,639,265 * 6/1997 Nishio et al. ..... 439/637
5,762,505 * 6/1998 Lin ..... 439/83
5,807,122 * 9/1998 Heeb et al. ..... 439/83
5,823,801 * 10/1998 Elkhatib ..... 439/83
5,938,456 * 4/1999 Kozel et al. ..... 439/83

FOREIGN PATENT DOCUMENTS 5-54922 3/1993 (JP) .
6-310197 11/1994 (JP) .
7-321277 12/1995 (JP) .
8-45623 2/1996 (JP) .

* cited by examiner

*Primary Examiner*—Tulsidas Patel
*Assistant Examiner*—Michael C. Zarroli
(74) *Attorney, Agent, or Firm*—Foley & Lardner

(57) ABSTRACT

A connector includes a connector housing and a plurality of contacts. Each of the plurality of contacts is composed of a contact section for contacting another contact, a lead section to be connected with a conductor, and a connecting section for connecting the contact section and the lead section. The lead section is composed of a bent portion and a flat portion provided substantially outside of said connector housing.

2 Claims, 3 Drawing Sheets

SURFACE INSTALLING TYPE CONNECTOR

BACKGROUND OF THE INVENTION

1. Field of the Invention

The present invention relates to a connector of a surface installing-type which is generally used to join a printed circuit board and another printed circuit board.

2. Description of the Related Art

A conventional example of a surface installing-type connector is described in Japanese Laid Open Patent Application (JP-A-Heisei 7-321277). According to the conventional example, a large-sized conductive pad is arranged in the corner of the package of a surface installing-type part which is installed on a printed circuit board to have a narrow pitch. When the large-sized conductive pad is dissolved in a re-flow process, the installing position of the part is corrected so that the part can be installed into an appropriate position.

In this conventional example of the surface installing-type connector, because an installing position error can be corrected, there is little possibility that any solder bridge is generated. However, it is difficult to completely prevent the generation of a solder bridge.

FIG. 1 shows a cross-sectional view of the conventional example of the surface installing-type connector. Referring to FIG. 1, the generation position of the solder bridge in the surface installing-type connector will be described below.

The position B where the solder bridge is generated is in a neighborhood of a point where a lead section 3*b* of the contact 3 is locally bent toward a contact section to have a right angle. The position B where the solder bridge is generated is located under a connector housing 2 of the surface installing-type connector 1. Moreover, the position B is positioned inside from the side surface of the connector housing 2.

The first problem of the conventional example of the surface installing-type connector is that the generating point of the solder bridge is near the central portion of the surface installing-type connector so that a watching test is difficult after installation of the surface installing-type connector. For this reason, the large-scale test apparatus such as an X-ray apparatus must be used for the test.

The generating point of the solder bridge is in the neighborhood of the point where the lead section of the contact is locally bent toward the contact section, and almost all of the solder bridges are generated at the points where the lead sections leave the printed circuit board. Because this local bending section is near the central portion of the connector, the watching test is difficult.

The second problem of the conventional example of the surface installing-type connector is that the solder bridges are generated in the central portion of the surface installing-type connector. For this reason, a soldering iron cannot be inserted to the soldering bridge generating point, which is generated in the central portion of the surface installing-type connector, although heat is applied to the tip portion of the lead section of the contact for repair. Accordingly, the heat is applied to the lease section extending outward. In this case, however, the application of the heat is difficult because the heating point is apart from the solder bridge generating point. Therefore, the workability of the repair is decreased.

SUMMARY OF THE INVENTION

The present invention is accomplished in view of the above problems. Therefore, an object of the present invention is to provide a surface installing-type connector in which a solder bridge can be easily found out and repair can be easily performed.

In order to achieve an aspect of the present invention, a connector includes a connector housing, and a plurality of contacts. Each of the plurality of contacts includes a contact section for contacting another contact, a lead section to be connected with a conductor and a connecting section for connecting the contact section and the lead section. The lead section includes a bent portion and a flat portion provided substantially outside of said connector housing.

The lead section may be bent in a plurality of points of said bent portion such that the flat portion extends in parallel to a surface of the conductor. In this case, the connecting section extends in a direction perpendicular to the surface of the conductor.

Alternatively, the lead section may be bent to have an arc in said bent portion such that the flat portion extends in parallel to a surface of the conductor. In this case, the connecting section extends in a direction perpendicular to the surface of the conductor.

The contact is formed of conductive and elastic material.

DESCRIPTION OF THE PREFERRED EMBODIMENTS

A surface installing-type connector of the present invention will be described below in detail with reference to the attached drawings.

Figure 1:
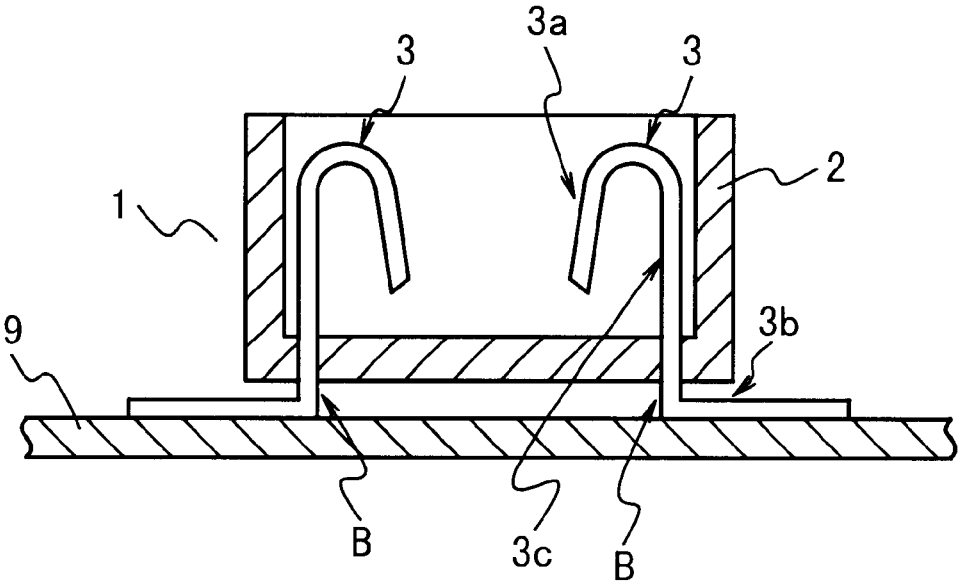
Fig. 1 PRIOR ART
FIG. 1 is a cross sectional view of a conventional example of a surface installing-type connector.
Figure 2A:
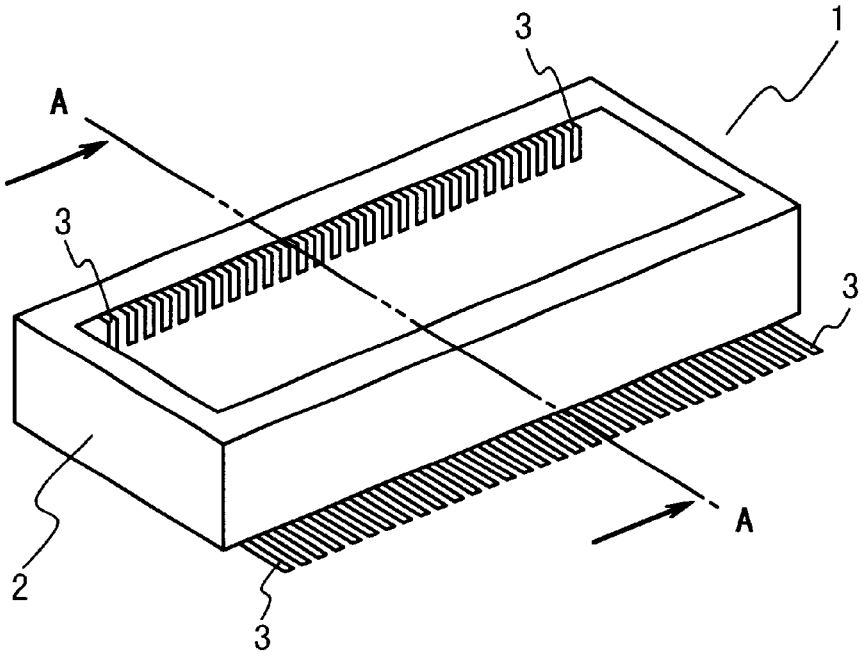
FIG. 2A is a perspective view of a surface installing-type connector according to a first embodiment of the present invention.
Figure 2B:
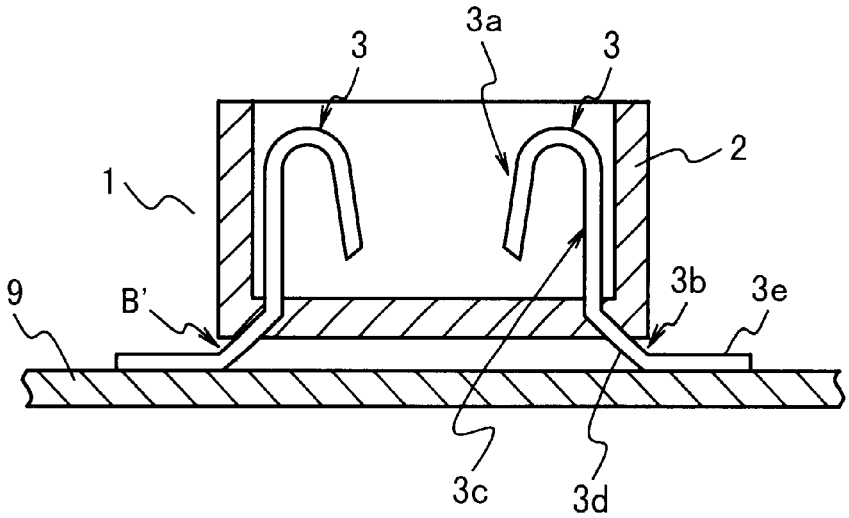
FIG. 2B is a cross sectional view of a surface installing-type connector according to the first embodiment of the present invention.

FIG. 2A is a perspective view of the surface installing-type connector according to the first embodiment of the present invention, and FIG. 2B is a cross sectional view of the surface installing-type connector according to the first embodiment of the present invention along the line A—A.

Referring to FIGS. 2A and 2B, the surface installing-type connector 1 of the first embodiment is composed of a connector housing 2 and a plurality of contacts 3.

The connector housing 2 has a box shape and is formed of insulative synthetic resin.

The plurality of contacts 3 are provided in the connector housing 2. Each of the contacts 3 is composed of a contact section 3*a* which contacts another contact (not illustrated) which is provided for a counter connector, a lead section 3*b* which is to be connected with a conductive pattern (not illustrated) provided on a printed circuit board 9, and a connecting section 3*c* for connecting the contact section 3*a* and a lead section 3*b*. The contact is formed of conductive and elastic material.

Moreover, the lead section 3*b* has a bent portion 3*d* and a flat portion 3*e*. The lead section 3*b* is not locally bent with a right angle in the bent portion 3*d* unlike the conventional example. The lead section 3*b* in this embodiment is bent in two points with a large and gentle angle in a portion near to the connecting section 3*c*. The flat portion 3*e* is a flat portion of the lead section 3*b* other than the bent portion 3*d*. This flat portion 3*e* is connected to the conductive pattern of the printed circuit board 9.

Because this bent portion 3*d* with the large and gentle angle exists in the lead section 3*b*, the flat portion 3*e* extends outward from the central portion of the connector housing 2 to be provided outside of the connector housing 2, when the surface installing-type connector 1 is installed on the printed circuit board 9. As a result, the point B' where it is easy for a solder bridge to be generated is positioned outside of the side of the connector housing 2.

It should be noted that although one end of the flat portion 3*e* is positioned inside of the side of the connector housing 2 in this embodiment, such a portion inside of the connector housing 2 is very short and almost all of the flat portion 3*e* is positioned outside of the side of the connector housing 2.

Figure 3:
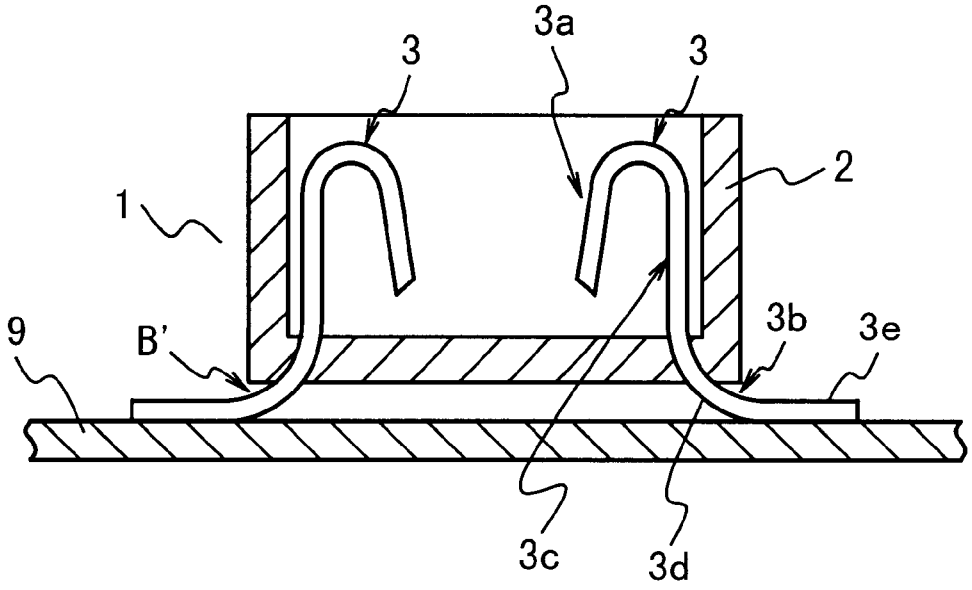
FIG. 3 is a cross sectional view of a surface installing-type connector according to a second embodiment of the present invention.

Also, the lead section 3*b* is bent in many positions in this embodiment. However, the present invention is not limited to this and the lead section 3*b* is bent in an arc shape manner in the surface installing-type connector according to the second embodiment of the present invention, as shown in FIG. 3.

As seen from the above description, in the surface installing-type connector, the connecting section 3*c* from the contact section 3*a* of the connector to the lead section 3*b* extends in a direction perpendicular to the surface of the printed circuit board. Accordingly, the lead section 3*b* extending from the connecting section 3*c* is necessary to be bent in parallel to the surface of the printed circuit board. In the conventional example, because the bending is performed locally, the bent point is located inside of the connector housing. Therefore, it is difficult to find out a solder bridge which is generated in the neighborhood of the bent point. However, in the present invention, the bending method of the lead section is changed so that a region of the lead section where it is easy for the solder bridge to be generated is provided substantially outside of the side of the connector housing.

As described above, according to the present invention, it is possible to easily perform a visual test after the installation of the surface installing-type connector. Therefore, the large-scale test apparatus such as an X-ray apparatus is not necessary. This is because the solder bridge generating point can be watched since the generating point exists outside of the side of the connector housing when the surface installing-type connector is installed with a narrow pitch.

Also, the repair is easy in the present invention. This is because application of heat becomes easy directly or via the lead section by a solder iron for repair since the solder bridge generating point exists outside of the side of the connector housing.

What is claimed is:

1. A connector comprising:

a connector housing; and a plurality of contacts, wherein each of said plurality of contacts comprises:

a contact section for contacting another contact;

a lead section; and a connecting section for connecting said contact section and said lead section, wherein said lead section comprises:

a bent portion; and a flat portion provided outside of said connector housing, and wherein said bent portion is straight and forms a first angle with said flat portion and a second angle with said connecting section, the first and second angles being greater than 90 degrees and less than 180 degrees, wherein said lead section is bent in a plurality of points such that said flat portion extends in parallel to a surface of a conductor, wherein the point where said bent portion and said flat portion meet is aligned with a vertical edge of said connector housing, and wherein said connecting section extends in a direction perpendicular to said surface of said conductor.

2. A connector according to claim 1, wherein said contact is formed of conductive and elastic material.

* * * * *